US008753159B1

(12) United States Patent
Brouillette et al.

(10) Patent No.: US 8,753,159 B1
(45) Date of Patent: Jun. 17, 2014

(54) WATERCRAFT HULL MEMBER

(75) Inventors: Steve Brouillette, Sherbrooke (CA); Sebastien Clement, Sherbrooke (CA)

(73) Assignee: Bombardier Recreational Products Inc., Valcourt, Quebec ( * ) Notice: Subject to any disclaimer, the term of this patent is extended or adjusted under 35 U.S.C. 154(b) by 458 days.

(21) Appl. No.: 13/036,153

(22) Filed: Feb. 28, 2011

(51) Int. Cl.
*B63H 21/00* (2006.01)

(52) U.S. Cl.
USPC ..... 440/111

(58) Field of Classification Search
USPC ..... 440/88 C–88 T, 88 HE, 111, 112
See application file for complete search history.

(56) References Cited

U.S. PATENT DOCUMENTS

| | | | | |
|---|---|---|---|---|
| 1,735,660 | A * | 11/1929 | Svendsen et al. | 440/62 |
| 2,103,183 | A * | 12/1937 | Rockwell | 440/112 |
| 2,258,526 | A | 10/1941 | Walter | |
| 2,356,844 | A | 8/1944 | Higgins | |
| 2,382,218 | A | 8/1945 | Fernstrum | |
| 2,577,194 | A | 12/1951 | Jannsen | |
| 2,682,852 | A * | 7/1954 | Ruffolo | 440/88 R |
| 2,976,834 | A * | 3/1961 | Waldron et al. | 440/88 R |
| 3,170,435 | A | 2/1965 | Najimian | |
| 3,240,179 | A | 3/1966 | Van Ranst | |
| 4,003,330 | A | 1/1977 | Compton | |
| 4,360,350 | A | 11/1982 | Grover | |
| 4,892,055 | A | 1/1990 | Schad | |
| 4,905,956 | A | 3/1990 | Zemlicka et al. | |
| 5,069,414 | A | 12/1991 | Smith | |
| 5,211,592 | A | 5/1993 | Alkema | |
| 5,387,047 | A | 2/1995 | Korpi | |
| 5,460,553 | A | 10/1995 | Craig et al. | |
| 5,695,371 | A | 12/1997 | Katoh | |
| 5,797,778 | A | 8/1998 | Ito et al. | |
| 5,964,178 | A | 10/1999 | Gonda | |
| 6,022,254 | A | 2/2000 | Neisen | |
| 6,544,085 | B1 | 4/2003 | Menard et al. | |

FOREIGN PATENT DOCUMENTS

JP 2002274489 A 9/2002

OTHER PUBLICATIONS

English abstract of JP 2002274489, Sep. 25, 2002.

* cited by examiner

*Primary Examiner* — Edwin Swinehart
(74) *Attorney, Agent, or Firm* — BCF LLP

(57) ABSTRACT

A watercraft includes a hull having an inside and an outside surface. A deck is disposed on the hull. The deck and the hull define an engine compartment. A power pack is disposed in the engine compartment. A propulsion unit is operatively connected to the power pack. At least one elongated member is disposed on the outside surface of the hull. The at least one elongated member is disposed at least in part forwardly of the propulsion unit. At least one connector joining a portion of the power pack to the at least one elongated member, the at least one connector extending through the hull. A member adapted to be disposed on an outside surface of a hull of the watercraft is also presented.

20 Claims, 12 Drawing Sheets

WATERCRAFT HULL MEMBER

TECHNICAL FIELD

The present invention relates to members for hulls of watercraft.

BACKGROUND

Watercraft typically have a hull, which buoyantly supports the watercraft in the water, and a deck disposed on the hull. Some watercraft are powered by one or more water jet propulsion systems to create thrust. The water jet propulsion system is driven by an engine disposed inside the hull below the deck. The engine is conventionally connected to the hull via a fixation system. The fixation system consists in one or more engine mounts bolted to an inside surface of the hull. The hull via the fixation system supports a weight of the engine.

In many watercraft, the hull is a unitary piece of fibre reinforced plastic, constructed to sustain the greatest local load, such as at the location of the engine fixation system. Hence the hull is thick even at places where it may not need to be. This in turn increases the weight of the watercraft, which makes the watercraft less efficient.

Additionally, positioning the engine within the hull is a matter of precision. The current engine fixation systems are connected to the hull at predetermined connections points, and allow only minimal adjustments of the location of the engine.

Therefore, there is a need for a hull that would be lighter. There is also a need for an engine mounting system that would allow precise positioning of the engine during initial installation of the engine in the watercraft.

SUMMARY

It is an object of the present invention to ameliorate at least some of the inconveniences present in the prior art.

In one aspect, a watercraft is provided. The watercraft comprises a hull having an inside and an outside surface. A deck is disposed on the hull. The deck and the hull define an engine compartment. A power pack is disposed in the engine compartment. A propulsion unit is operatively connected to the power pack. At least one elongated member is disposed on the outside surface of the hull. The at least one elongated member is disposed at least in part forwardly of the propulsion unit. At least one connector joins a portion of the power pack to the at least one elongated member. The at least one connector extends through the hull.

In an additional aspect, the at least one elongated member is removably connected to the hull.

In a further aspect, a stiffness of the at least one elongated member is greater than a stiffness of the hull.

In an additional aspect, the at least one elongated member includes at least one rail. The at least one connector has a first portion engaged with the portion of the power pack. The at least one connector has a second portion engaged with the at least one rail.

In a further aspect, for each of the at least one rail, the at least one connector is two connectors. The two connectors have their respective first portions engaged in the portion of the power pack. The two connectors have their respective second portions engaged in the at least one rail.

In an additional aspect, the watercraft has a longitudinal direction. The at least one elongated member is disposed on the outside surface of the hull and extends in the longitudinal direction of the watercraft.

In a further aspect, the at least one elongated member is shaped to form at least a portion of a strake of the hull.

In an additional aspect, the hull further comprises a keel centrally disposed thereonto. The at least one elongated member is laterally spaced from the keel.

In an additional aspect, the portion of the power pack is an engine of the watercraft. The at least one connector includes at least one engine mount connected to the engine.

In a further aspect, the at least one connector further includes at least one engine bracket connected to the engine. The at least one engine bracket is received in part in the at least one engine mount.

In an additional aspect, the hull includes at least one elongated recess sized and shaped to receive the at least one elongated member at least partially therein.

In a further aspect, the portion of the power pack is an engine of the watercraft. The at least one elongated member includes at least one heat exchanger. The at least one heat exchanger is in fluid communication with the engine. The at least one heat exchanger is positioned on the hull to be at least partially in contact with a body of water when the watercraft is in the body of water.

In an additional aspect, the at least one connector includes at least one engine mount connected to the engine. The at least one elongated member includes at least one rail. The at least one connector has a first portion engaged with the engine. The at least one connector has a second portion engaged with the at least one rail.

In a further aspect, at least one conduit fluidly is connecting the engine to the at least one heat exchanger. The at least one conduit carries a coolant.

In an additional aspect, the at least one heat exchanger includes at least one internal aperture. When in operation the coolant is transported through the at least one internal aperture from the at least one conduit.

In another aspect, a member adapted to be disposed on an outside surface of a hull of the watercraft is provided. The member comprises an elongated body defining a longitudinal direction, and at least one internal aperture in the longitudinal direction. At least one rail is disposed on one side of the elongated body. The at least one rail is adapted to receive at least one connector for connecting the member to the hull.

In an additional aspect, the at least one internal aperture includes two internal apertures in the longitudinal direction disposed adjacent to each other. The two internal apertures are fluidly connected to each other. Each of the two internal apertures is adapted to be fluidly connected to a conduit. One of the two internal apertures is adapted to receive a coolant from its corresponding conduit. The other one of the two internal apertures is adapted to transfer the coolant to its corresponding conduit from the one of the two internal apertures.

In a further aspect, the at least one rail extends in the longitudinal direction.

In an additional aspect, an apex is disposed on a side of the elongated member opposite to the at least one rail.

For purposes of this application, terms related to spatial orientation such as forwardly, rearwardly, left, and right, are as they would normally be understood by a driver of the watercraft sitting thereon in a normal driving position.

Embodiments of the present invention each have at least one of the above-mentioned aspects, but do not necessarily have all of them.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

Figure 1:
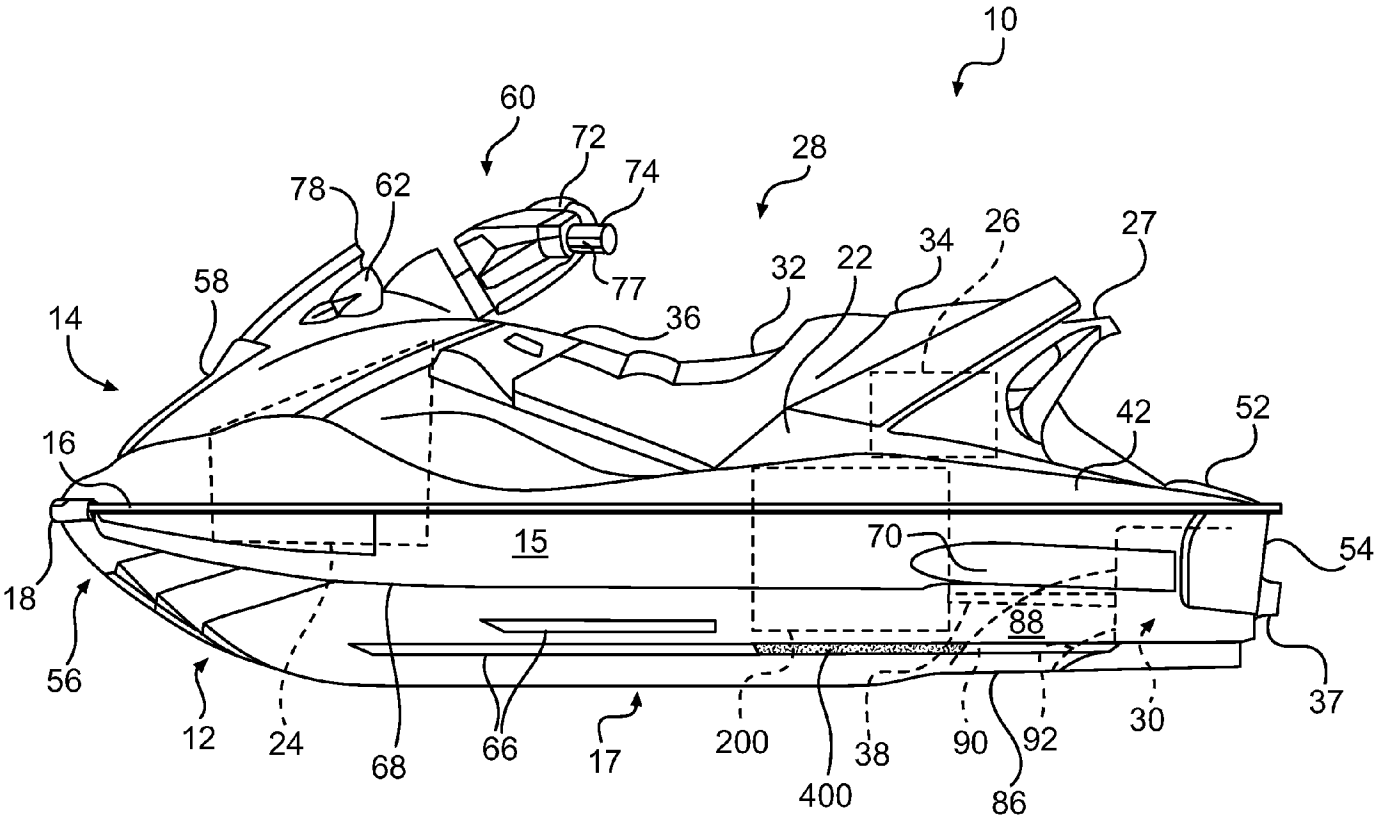
FIG. 1 is a left side elevation view of a personal watercraft with a hull reinforcement member shown shaded.

Referring to FIG. 1, the general construction of a personal watercraft 10 will be described. It should be understood that the personal watercraft 10 could be another type of watercraft, and could have a construction other than the one described.

The watercraft 10 is made of two main parts, including a hull 12 and a deck 14. The hull 12 buoyantly supports the watercraft 10 in the water. The deck 14 is designed to accommodate a rider and, in some watercraft, one or more passengers. The hull 12 and deck 14 are joined together at a seam 16 that joins the parts in a sealing relationship. Preferably, the seam 16 comprises a bond line formed by an adhesive. Other known joining methods could be used to sealingly engage the parts together, including but not limited to thermal fusion, molding or fasteners such as rivets or screws. A bumper 18 generally covers the seam 16, which helps to prevent damage to the outer surface of the watercraft 10 when the watercraft 10 is docked, for example. The bumper 18 can extend around the bow 56, as shown, or around any portion or all of the seam 16.

Figure 6:
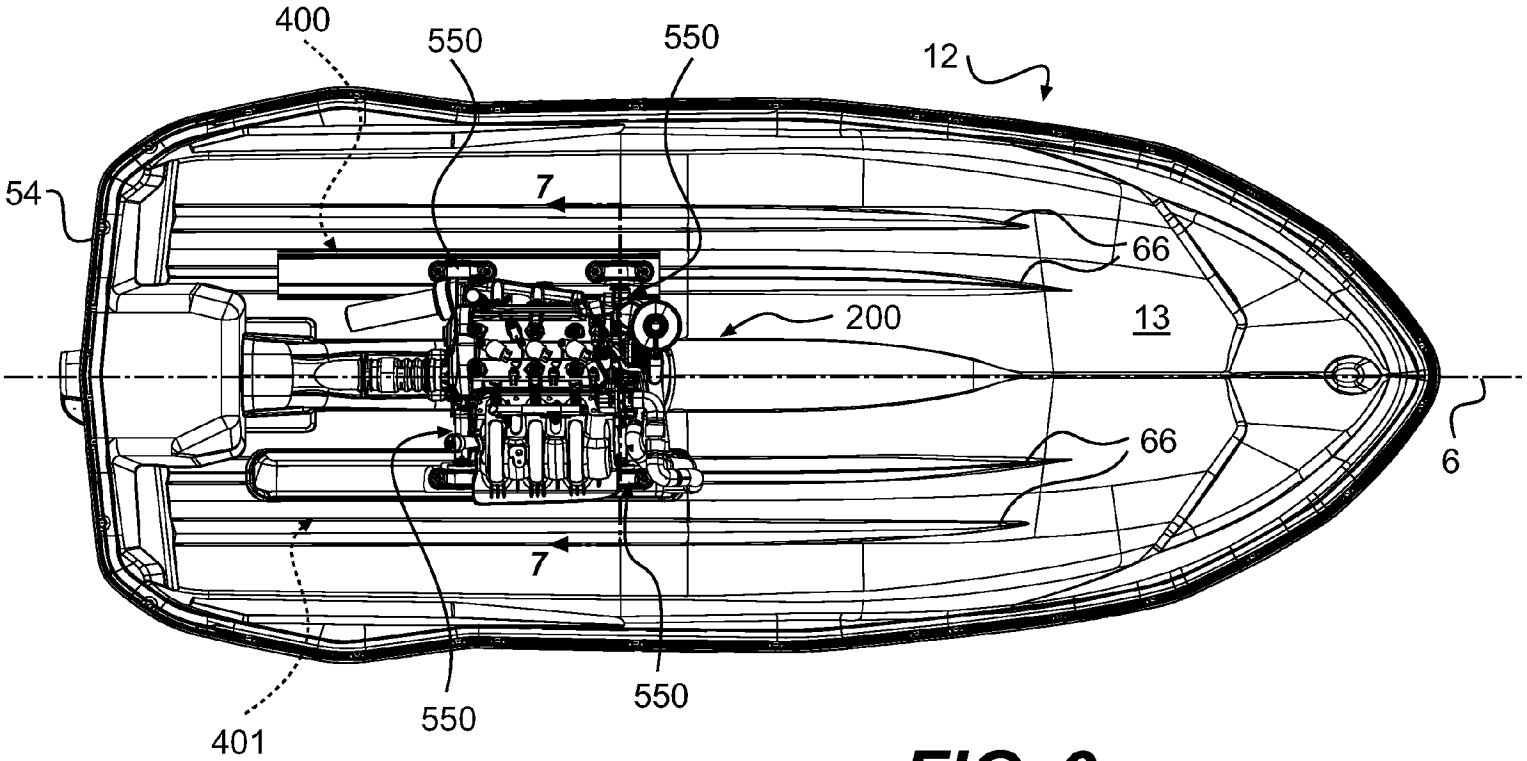
FIG. 6 is a top plan view of an inside of a hull and the engine of the watercraft of FIG. 1.

The hull 12 has an inside 13 (shown in FIG. 6) and an outside surface 15. The space between the inside 13 of the hull 12 and the deck 14 forms a volume, sometimes referred to as the engine compartment. The engine compartment accommodates a power pack which includes an engine 200 having an engine casing 203 (shown in FIG. 4), as well as an exhaust system, a driveshaft assembly, an oil tank 260, electrical system (battery, electronic control unit, etc.), and an air box 213. The power pack may include other elements required or desirable in the watercraft 10. The engine 200 will be described in greater details below.

The deck 14 has a centrally positioned straddle-type seat 28 positioned on top of a pedestal 22 to accommodate a rider in a straddling position. The seat 28 is sized to accommodate one or more riders. The seat 28 includes a first, front seat portion 32 and a rear, raised seat portion 34 that accommodates a passenger. The seat 28 is preferably made as a cushioned or padded unit or interfitting units. The seat portions 32, 34 are removably attached to the pedestal 22 by a hook and tongue assembly (not shown) at the front of each seat and by a latch assembly (not shown) at the rear of each seat, or by any other known attachment mechanism. The seat portions 32, 34 can be individually tilted or removed completely. One of the seat portions 32, 34 covers an engine access opening defined by a top portion of the pedestal 22 to provide access to the engine 200. The other seat portion (in this case portion 34) covers a storage bin 26. A "glove compartment" or small storage box 36 is provided in front of the seat 28. A grab handle 27 is provided between the pedestal 22 and the rear of the seat 28 to provide a handle onto which a passenger may hold.

The watercraft 10 has a pair of generally upwardly extending walls located on either side of the watercraft 10 known as gunwales or gunnels 42. The gunnels 42 help to prevent the entry of water in the footrests (not shown) of the watercraft 10, provide lateral support for the rider's feet, and also provide buoyancy when turning the watercraft 10, since personal watercraft roll slightly when turning.

A reboarding platform 52 is provided at the rear of the watercraft 10 on the deck 14 to allow the rider or a passenger to easily reboard the watercraft 10 from the water. Carpeting or some other suitable covering covers the reboarding platform 52. A retractable ladder (not shown) may be affixed to a transom 54 of the watercraft 10 to facilitate boarding the watercraft 10 from the water onto the reboarding platform 52.

The watercraft 10 is provided with a hood 58 located forwardly of the seat 28 and a steering assembly including a helm assembly 60. A hinge (not shown) is attached between a forward portion of the hood 58 and the deck 14 to allow hood 58 to move to an open position to provide access to a storage bin 24. A latch (not shown) located at a rearward portion of hood 58 locks hood 58 into a closed position. When in the closed position, hood 58 prevents water from entering the storage bin 24. Rearview mirrors 62 are positioned on either side of hood 58 to allow the rider to see behind the watercraft 10. A hook (not shown) is located at the bow 56 of the watercraft 10. The hook is used to attach the watercraft 10 to a dock when the watercraft is not in use or to attach to a winch when loading the watercraft 10 on a trailer, for instance.

The outside surface 15 of the hull 12 is provided with a keel 17 and a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics. The outside surface 15 of the hull 12 also includes a port elongated member 400 and a starboard elongated member 401 (both shown in FIG. 7) received in recesses 19 of the hull 12. The port elongated member 400 and the starboard elongated member 401 are disposed laterally spaced from the keel 17 in a longitudinal direction 6 of the watercraft 10. The port and starboards elongated members 400, 401 are reinforcement members of the hull 12. In addition, as will be described below, the starboard elongated member 401 works as a heat exchanger. It is contemplated that the hull 12 could include only one or more than two elongated members 400, 401. It is also contemplated that the elongated member 401 could be a reinforcement member, and that the elongated member 400 could be a heat exchanger. It is contemplated that the elongated members 400, 401 could both be reinforcement members with no heat exchange function, or both be reinforcement members with heat exchange function. It is contemplated that the elongated members 400, 401 could not be received in recesses 19 of the hull 12. It is contemplated that the recesses 19 could have a shape different from the one shown in the Figures. It is also contemplated that the elongated members 400, 401 could be disposed at an angle from the longitudinal direction 6. The elongated members 400, 401 will be described in greater details below.

Sponsons 70 are located on both sides of the hull 12 near the transom 54. The sponsons 70 preferably have an arcuate undersurface that gives the watercraft 10 both lift while in motion and improved turning characteristics. The sponsons 70 are preferably fixed to the outside surface 15 of the hull 12 and can be attached to the hull 12 by fasteners or molded therewith. Sometimes it may be desirable to adjust the position of the sponson 70 with respect to the hull 12 to change the handling characteristics of the watercraft 10 and accommodate different riding conditions.

The helm assembly 60 is positioned forwardly of the seat 28. The helm assembly 60 has a central helm portion 72, which may be padded, and a pair of steering handles 74, also referred to as a handlebar. One of the steering handles 74 is preferably provided with a throttle operator (not shown), which allows the rider to control the engine 200, and therefore the speed of the watercraft 10. The throttle operator can be in the form of a thumb-actuated throttle lever, a finger-actuated throttle lever, or a twist grip. The throttle operator is movable between an idle position and multiple actuated positions. The throttle operator is preferably biased towards the idle position, such that when the driver of the watercraft 10 lets go of the throttle operator, it will move to the idle position. The other of the steering handles 74 is provided with a lever 77 used by the driver to control a reverse gate of a jet propulsion system 30.

The jet propulsion system 30 pressurizes water to create thrust. The water is first scooped from under the hull 12 through an inlet 86, which has an inlet grate. The inlet grate prevents large rocks, weeds, and other debris from entering the jet propulsion system 30, which may damage the system or negatively affect performance. The inlet grate could be omitted. Water flows from the inlet 86 through a water intake ramp 88. The top portion 90 of the water intake ramp 88 is formed by the hull 12, and a ride shoe (not shown) forms its bottom portion 92. Alternatively, the water intake ramp 88 may be a single piece or an insert to which the jet propulsion system 30 attaches. In such cases, the water intake ramp 88 and the jet propulsion system 30 are attached as a unit in a recess in a bottom of hull 12. The jet propulsion system 30 will be described in greater details below.

The jet propulsion system 30 is provided with the reverse gate (not shown) which is movable in response to actuation of the lever 77 between a stowed position where it does not interfere with a jet of water being expelled by the steering nozzle 37 and one or more positions where it redirects the jet of water being expelled by the steering nozzle 37 (described in greater detail below). It is contemplated that the reverse gate could be omitted.

A display area or cluster 78 is located forwardly of the helm assembly 60. The display cluster 78 can be of any conventional display type, including a liquid crystal display (LCD), dials or LED (light emitting diodes). The central helm portion 72 has various buttons (not shown), which could alternatively be in the form of levers or switches, that allow the rider to modify the display data or mode (speed, engine rpm, time . . . ) on the display cluster 78. Buttons (not shown) may also be used by the driver to control the jet propulsion system 30. The watercraft 10 includes other features well known in the art that will not be described here.

Figure 2:
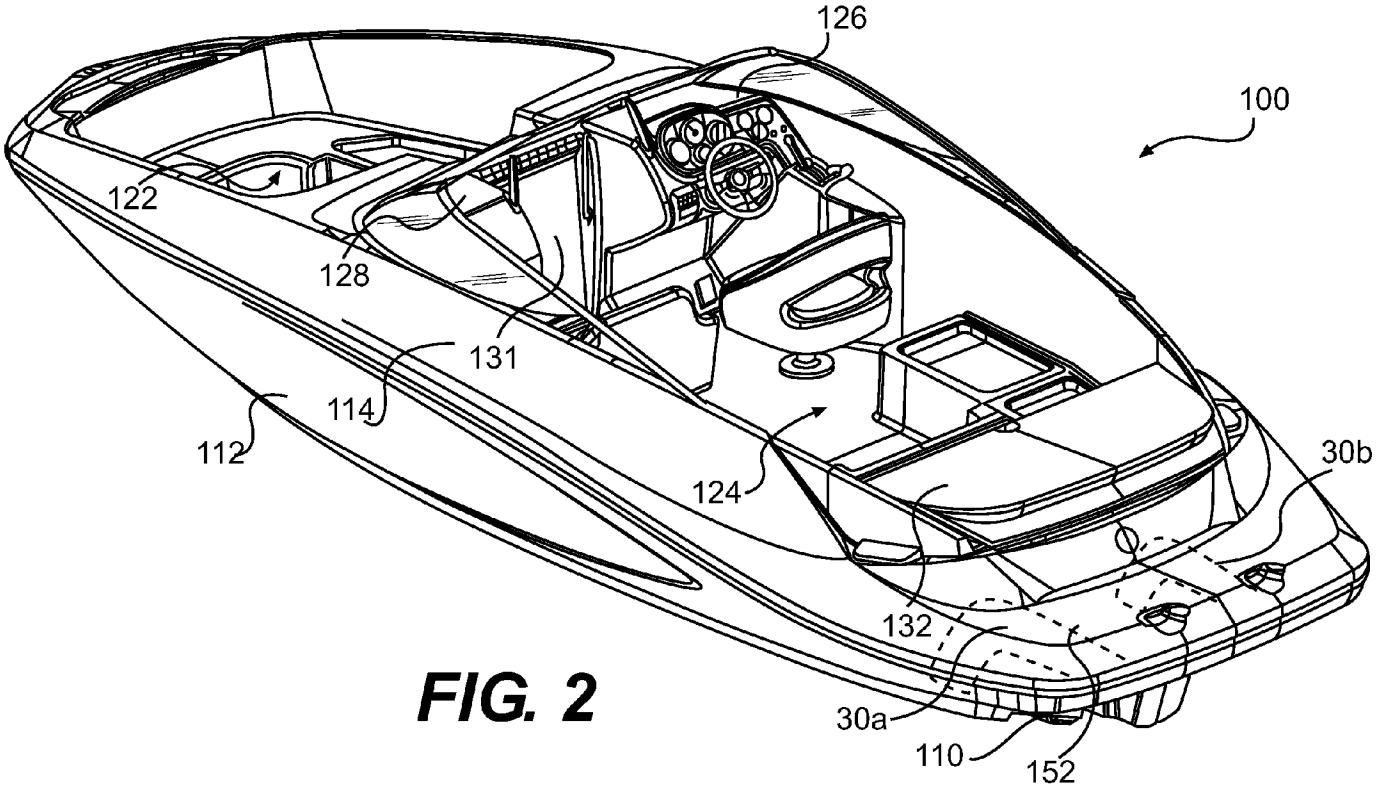
FIG. 2 is a perspective view of a sport boat taken from a rear, left side thereof.

The general construction of a sport boat 100 in accordance with this invention will now be described with respect to FIG. 2. It should be understood that the sport boat 100 could be another type of boat, and could have a construction other than the one described.

The sport boat 100 has a hull 112 and a deck 114 supported by the hull 112. The deck 114 has a forward passenger area 122 and a rearward passenger area 124. A right console 126 and a left console 128 are disposed on either side of the deck 114 between the two passenger areas 122, 124. A passageway disposed between the two consoles 126, 128 allows for communication between the two passenger areas 122, 124. A door 131 is used to selectively open and close the passageway.

Two engines (not shown) are located between the hull 112 and the deck 114 at the back of the boat 100. The two engines power two jet propulsion systems 30*a* and 30*b*. The engines and water jet propulsion systems 30*a* and 30*b* are of similar construction as the engine 200 and the water jet propulsion system 30, respectively, of the personal watercraft 10 described above, and will be described in greater details below with respect to the engine 200 and the water jet propulsion system 30, respectively. It is contemplated that, the boat 100 could have only one engine powering only one jet propulsion system.

The hull 112 includes port and starboards elongated members (not shown), which include reinforcement members of the hull 112, and heat exchangers connected to the engines of the jet propulsions systems 30*a*, 30*b* similar to the elongated members 400, 401. The elongated members will be described in greater details below with respect to the elongated members 400, 401.

Two reverse gates 110 (only one being shown) are operatively mounted to the hull 112. The reverse gates 110 are well known in the art, and will therefore not be described herein. The engines are accessible through a lid 132 located behind the rearward passenger area 124. The lid 132 can also be used as a sundeck for a passenger of the boat 100 to sunbathe on while the boat 100 is not in operation. A reboarding platform 152 is located at the back of the deck 114 for passengers to easily reboard the boat 100 from the water.

The sports boat 100 includes other features, well known in the art, that will not be described herein, such as the electrical and fuel systems for example. It should be understood that such features are nonetheless present in the boat 100.

Figure 3:
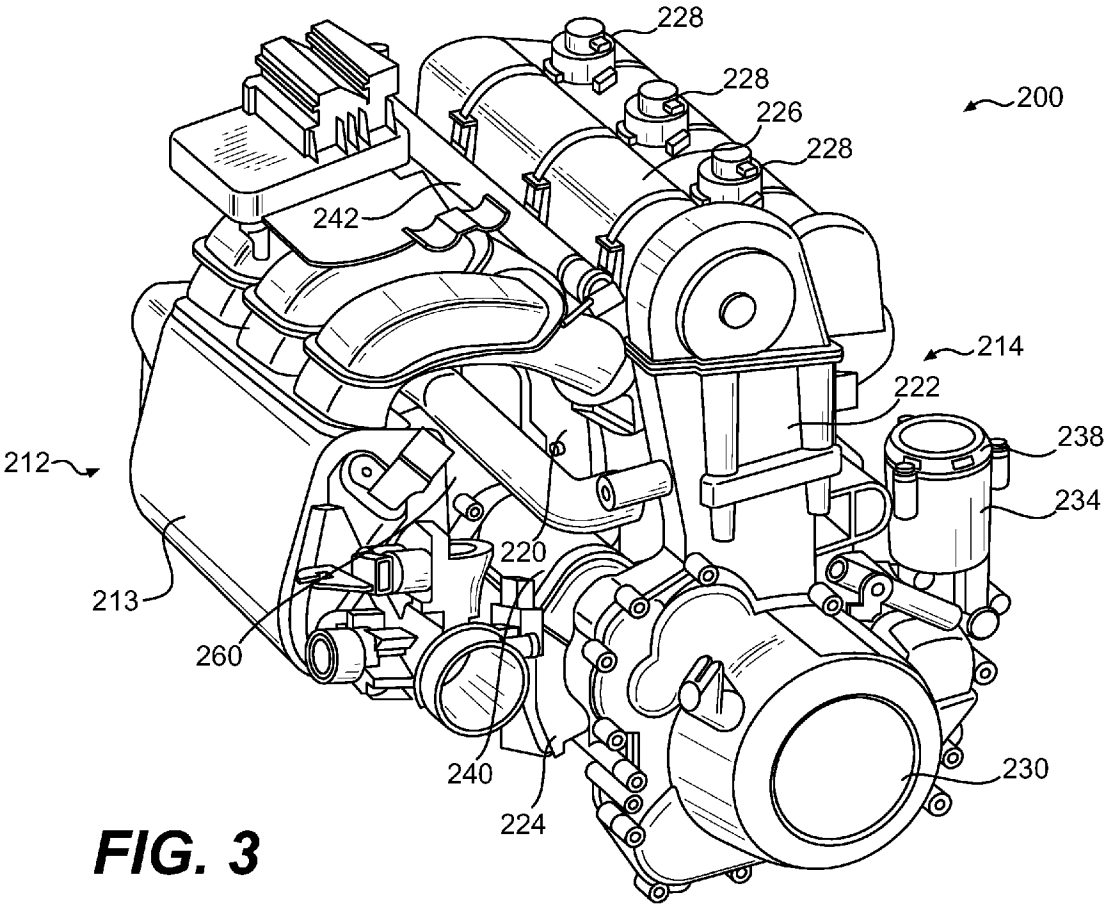
FIG. 3 is a perspective view taken from a front right side of an engine for the watercraft of FIG. 1.
Figure 4:
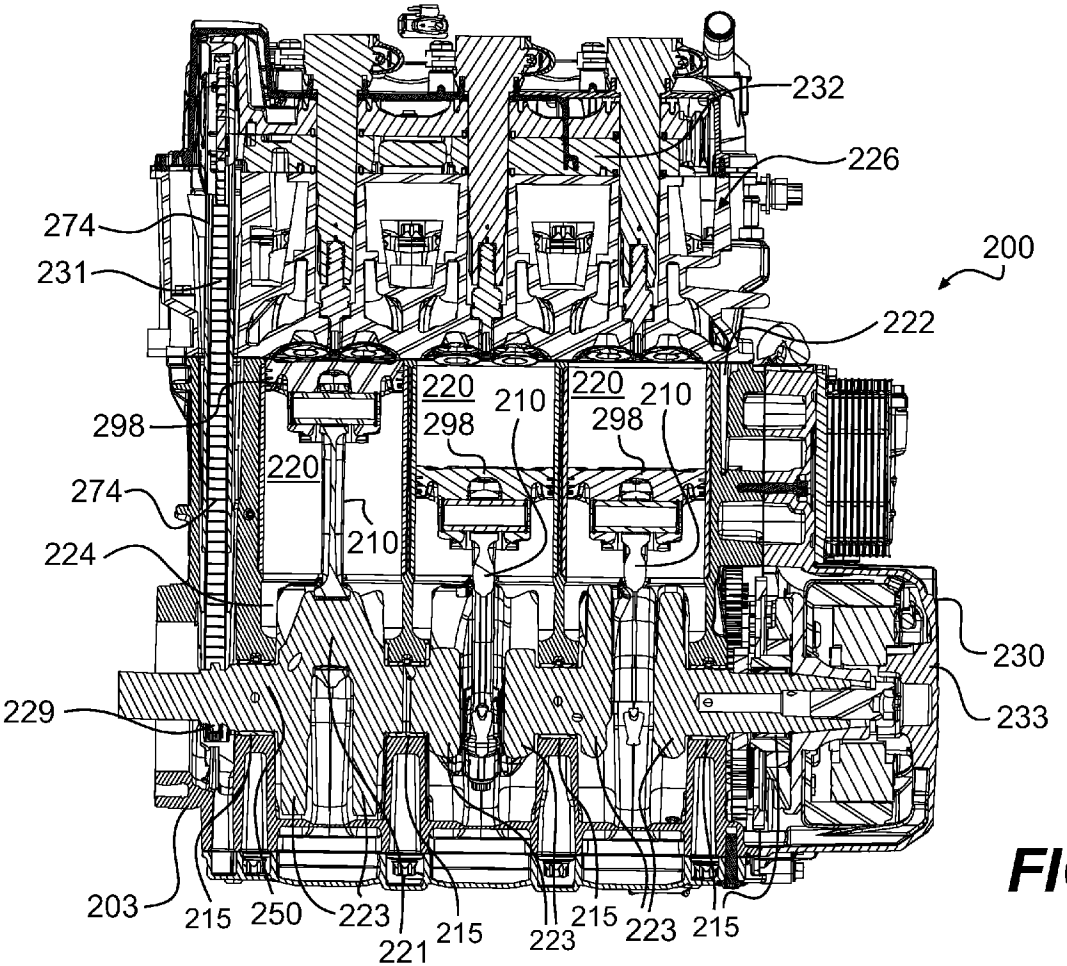
FIG. 4 is a cross-sectional view of the engine of FIG. 3 taken through a vertical plane passing through an axis of rotation of a crankshaft of the engine.

Turning now to FIGS. 3 and 4, the engine 200 will be described in greater detail. The engines of the sport boat 100 have a construction similar to that of the engine 200, and will therefore not be described here. The engine 200 is only one possible engine that could be used. It is contemplated that other types of engines could be used.

The engine 200 has three cylinders 220 disposed in a straight line next to each other. It is contemplated that a greater or fewer numbers of cylinders 220 could be used. All of the cylinders 220 are formed in a cylinder block 222, which sits atop a crankcase 224. A cylinder head assembly 226 sits atop the cylinder block 222. A spark plug 228 is provided in the cylinder head assembly 226 for each cylinder 220. A magneto cover 230 is bolted to the crankcase 224 on the first end of the engine 200 to cover a magneto 233 (shown in FIG. 4) and other components of the engine 200. An oil filter housing 234 is also provided at the first end of the engine 200 on the same side as exhaust components 214 to house an oil filter (not shown). The oil filter housing 234 has a removable cap 238 provided at the top thereof to allow for easy access to the oil filter, thereby facilitating maintenance of the engine 200. A starter motor 240 is also provided at the first end of the engine 200 alongside the cylinder block 222 on the same side as the intake components 212. The starter motor 240 is an electrical motor which, as is known by those skilled in the art, is operatively connected to a crankshaft 250. The starter motor 240 initiates the rotation of the crankshaft 250 to allow for the initial ignition(s) to occur, which then allows the engine 200 to run. A fuel rail 242 disposed on the air intake components 212 receives fuel from a fuel tank (not shown) and delivers it to three fuel injectors (not shown). Each fuel injector is in fluid communication with the intake passages (not shown) of each cylinder 220.

An oil tank 260 is connected to the engine 200 on an intake side of the engine 200 below the air intake components 212. The oil tank 260 is shaped such that it follows the contour of the cylinder block 222 and the crankcase 224.

As best seen in FIG. 4, a piston 298 is housed inside each cylinder 220 and reciprocates therein. For each cylinder 220, the walls of the cylinder 220, the cylinder head assembly 226 and the top of the piston 298 form a combustion chamber. The pistons 298 are linked to the crankshaft 250, which is housed in the crankcase 224, by connecting rods 210. Explosions caused by the combustion of an air/fuel mixture inside the combustion chambers make the pistons 298 reciprocate inside the cylinders 220 which causes a crankshaft 250 to rotate inside the crankcase 224.

The crankshaft 250 is supported for rotation in the crankcase 224 by five plain bearings 215. The crankshaft 250 has three crankpins 221 (only one being shown in FIG. 4) onto which the connecting rods 210 are connected. Each crankpin 221 has a pair of corresponding counterbalance weights 223 opposite thereto to counteract the forces generated by the reciprocating pistons 298. The space between the counterbalance weights 223 is selected such that the connecting rod 210 which is connected to the corresponding crankpin 221 can pass therebetween.

A sprocket 229 is disposed on the crankshaft 250. The sprocket 229 engages a timing chain 231, so as to drive a first camshaft 232. The timing chain 231 is disposed at least in part inside a timing chain case 274 located at the end of the engine 200 opposite to the end where the magneto cover 230 is located.

The cylinder head assembly 226 has two camshafts (only a first camshaft 232 being shown). The first camshaft 232 and second camshaft are generally horizontal and parallel to the crankshaft 250. Sprockets (not shown) disposed at one end of the two camshafts engage the timing chain 231 such that the first camshaft 232 and the second camshaft are driven by the sprocket 229 of the crankshaft 250. As they rotate, the camshafts cause intake and exhaust valves of the engine 200 to open and close.

The engine 200 includes other features well known in the art and not described herein.

Figure 8:
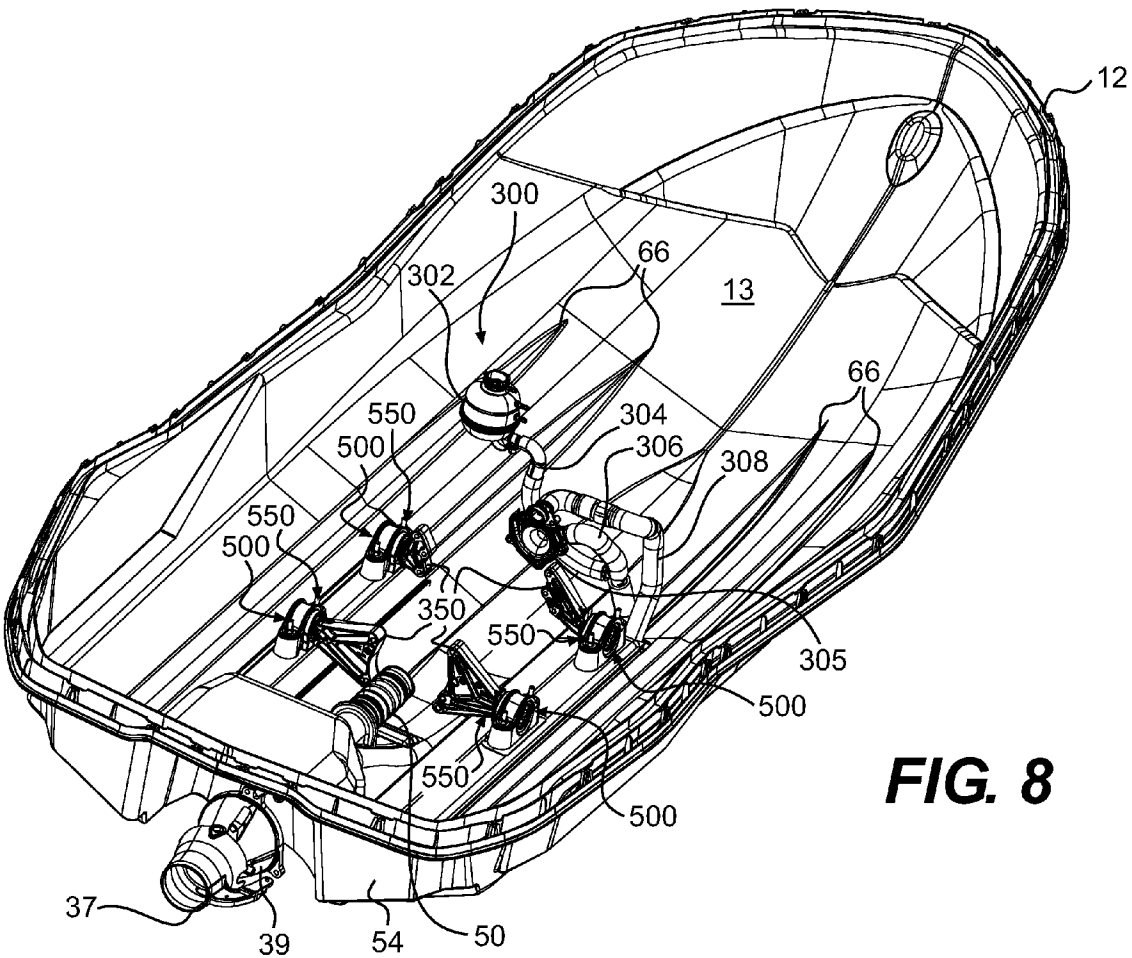
FIG. 8 is a perspective view taken from a top, rear, right side of the hull of FIG. 6 with the engine removed for clarity.

The engine 200 is cooled down by a cooling system 300. As best shown in FIG. 8, the cooling system 300 includes a reservoir 302 containing a coolant fluid. A coolant pump, located in a housing 305, is disposed on an outside of the engine casing 203. The housing 305 is made of plastic and is bolted onto the engine casing 203. The housing 305 is fluidly connected to the conduit 306 and the engine 200. It is contemplated that the coolant pump could be located inside the engine casing 203. A conduit 304 fluidly communicates the reservoir 302 with a conduit 306. The conduit 306 fluidly communicates coolant that has flown through the engine 200 to an inlet port 425 (shown in FIG. 12) of the elongated member/heat exchanger 401. A conduit 308 fluidly communicates coolant that has flown through the elongated member/heat exchanger 401 from an outlet port 427 (shown in FIG. 12) of the elongated member 401 back to the engine 200. Thus, in operation, the coolant flows in the engine 200 which transmits its heat to the coolant, then flows in the elongated member 401, which is in contact with a body of water.

Figure 5:
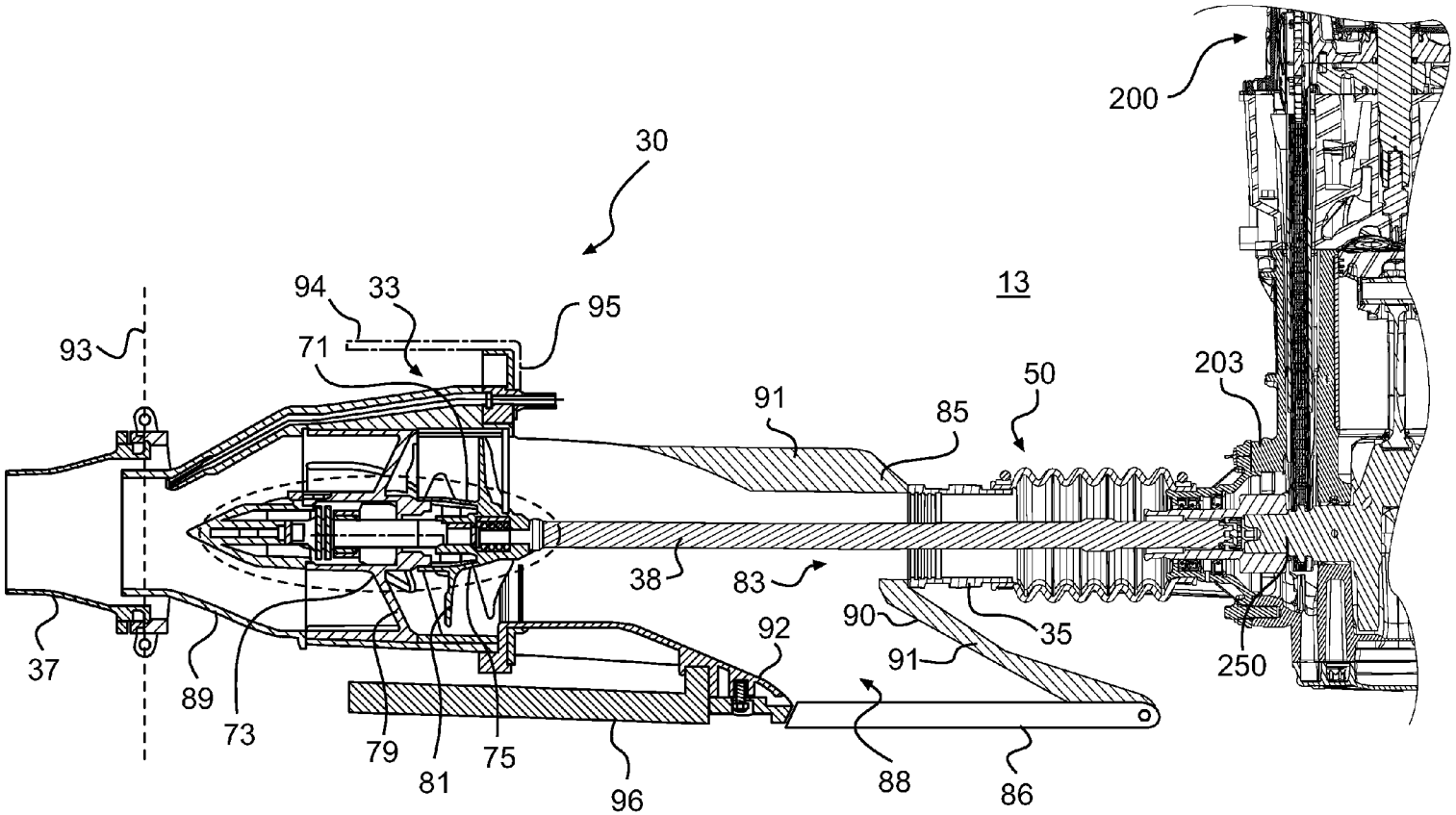
FIG. 5 is a cross-sectional view of a jet propulsion system of the watercraft of FIG. 1, and of a rear portion of the engine of FIG. 3.

Turning to FIG. 5, the water jet propulsion system 30 will now be described in greater detail. The water jet propulsion systems 30*a*, 30*b* of the boat 100 have a similar construction, and as such will not be described herein in detail.

As mentioned above, the jet propulsion system 30 pressurizes water to create thrust. The jet propulsion system 30 is partially located in a formation in the hull 12, referred to as the tunnel 94. The tunnel 94 is defined at the front, sides, and top by walls formed by the hull 12 and is open at the transom 54. The bottom of the tunnel 94 is closed by a ride plate 96. The ride plate 96 creates a surface on which the watercraft 10 rides or planes at high speeds. This configuration reduces the projection of the jet propulsion system 30 from the back of the watercraft 10.

The jet propulsion system 30 includes a jet pump 33. The forward end of the jet pump 33 is connected to a front wall 95 of the tunnel 94. The jet pump includes an impeller 71 and a stator 73. The impeller includes blades 81 that extend from a center portion 75. The impeller 71 is coupled to the engine 200 by a driveshaft 38. An end of the driveshaft 38 is operatively connected to the engine 200 via the crankshaft 250. The engine 200 powers the impeller 71, which pressurizes the water. The water then moves over the stator 73 that is made of a plurality of fixed stator blades 79. The role of the stator blades 79 is to decrease the rotational motion of the water so that almost all the energy given to the water is used for thrust, as opposed to swirling the water. Once the water leaves the jet pump 33, it goes through a venturi 89 that is connected to the rearward end of the jet pump 33. Since the venturi's 89 exit diameter is smaller than its entrance diameter, the water is accelerated further, thereby providing more thrust.

The steering nozzle 37 is rotationally mounted relative to the venturi 89, so as to pivot about a steering axis 93. The steering nozzle 37 is operatively connected to the helm assembly 60 preferably via a push-pull cable (not shown) such that when the helm assembly 60 is turned, the steering nozzle 37 pivots about the steering axis 93. This movement redirects the pressurized water coming from the venturi 89, so as to redirect the thrust and steer the watercraft 10 in the desired direction. It is contemplated that the steering nozzle 37 could be omitted, in which case alternative means may be provided for steering the watercraft 10. For example, the watercraft 10 may alternatively be steered by one or more rudders, or by having two laterally spaced jet pumps that are selectively powered to steer the boat 100 in the desired direction.

As mentioned above, the driveshaft 38 is connected to the crankshaft 250 for transmitting the power generated by the engine 200 to the jet propulsion system 30. The driveshaft 38 extends through the top portion 90 of the water intake ramp 88 into the inside 13 of the hull 12. To that effect, the top portion 90 includes a front wall 91 which has an aperture 83, through which the driveshaft 38 extends. A through-hull fitting 35 extends in an inside 13 of the hull 12 from the front wall 91 and surrounds the aperture 83. The front wall 91 has a connecting part 85 around the aperture 83 to connect to the through-hull fitting 35. The through-hull fitting 35 is a tube disposed around a portion of the driveshaft 38. It is contemplated that the entire driveshaft 38 could be surrounded by a protective sleeve. It is contemplated that the through-hull fitting 35 could include more than one tube, as well as other components. It is also contemplated that the connecting part 85 could be omitted. It is contemplated that the through-hull fitting 35 could be omitted, or could be integrally formed with the connecting part 85.

The driveshaft 38 is surrounded by a sealing unit 50. The sealing unit 50 provides liquid isolation between, on one hand, the water intake ramp 88 and the inside 13 of the hull 12 (water coming from the water intake ramp 88, entering about the aperture 83 where the driveshaft 38 extends from the hull 12), and on the other hand between the engine 200 and the inside 13 of the hull 12 (engine oil coming from inside the crankcase 224 of the engine 200).

Turning now to FIGS. 6 to 9, attachment of the engine 200 to the hull 12 of the watercraft 10 will be described. Attachments of the engines of the jet propulsion systems 30*a*, 30*b* of the boat 100 are similar to the ones of the engine 200 of the watercraft 10, and will not be described again.

The engine 200 is mounted to the elongated members 400, 401 at the bottom of the inside 13 of the hull 12 via four engine brackets 350 engaged in corresponding engine mounts 500. The engine mounts 500 are connected to the elongated members 400, 401 through the hull 12, such that the hull 12 is sandwiched between the engine mounts 500 and the elongated members 400, 401. The engine brackets 350 and corresponding engine mounts 500 form connectors 550 for connecting the engine 200 to the elongated members 400, 401. It is contemplated that that a portion of the power pack other than the engine 200 could be connected to the elongated members 400, 401. In such case, the engine 200 may be connected to hull 12 directly without being connected to the elongated members 400, 401. It is also contemplated that the connectors 550 could not include the engine brackets 350. For example, the engine brackets 350 could be integrally formed with the engine casing 203.

The engine brackets 350 are brackets of aluminum bolted to the engine 200. The four engine brackets 350 are different from each other, and include several apertures 352 and apertures 354. The apertures 352 reduce a weight of the engine brackets 350. The apertures 354 are used to connect the engine brackets 350 to the engine 200. The engine brackets 350 are shaped to conform to a shape of the engine 200 at a position where they connect to the engine 200. It is contemplated that some or all of the engine brackets 350 could be identical. It is also contemplated that more or less than four engine brackets 350 could be used to attach the engine 200 to the hull 12. It is contemplated that the engine brackets 350 could be made of another type of metal. It is contemplated that the engine brackets 350 could be integrally formed with the engine casing 203. It is contemplated that the engine brackets 350 could have only one or no aperture 352. The engine brackets 350 are shown in the Figures connecting lateral sides of the engine casing 203. However, it is contemplated that, some or all of the engine brackets 350 could be connecting front and/or rear of the engine casing 203.

Figure 9:
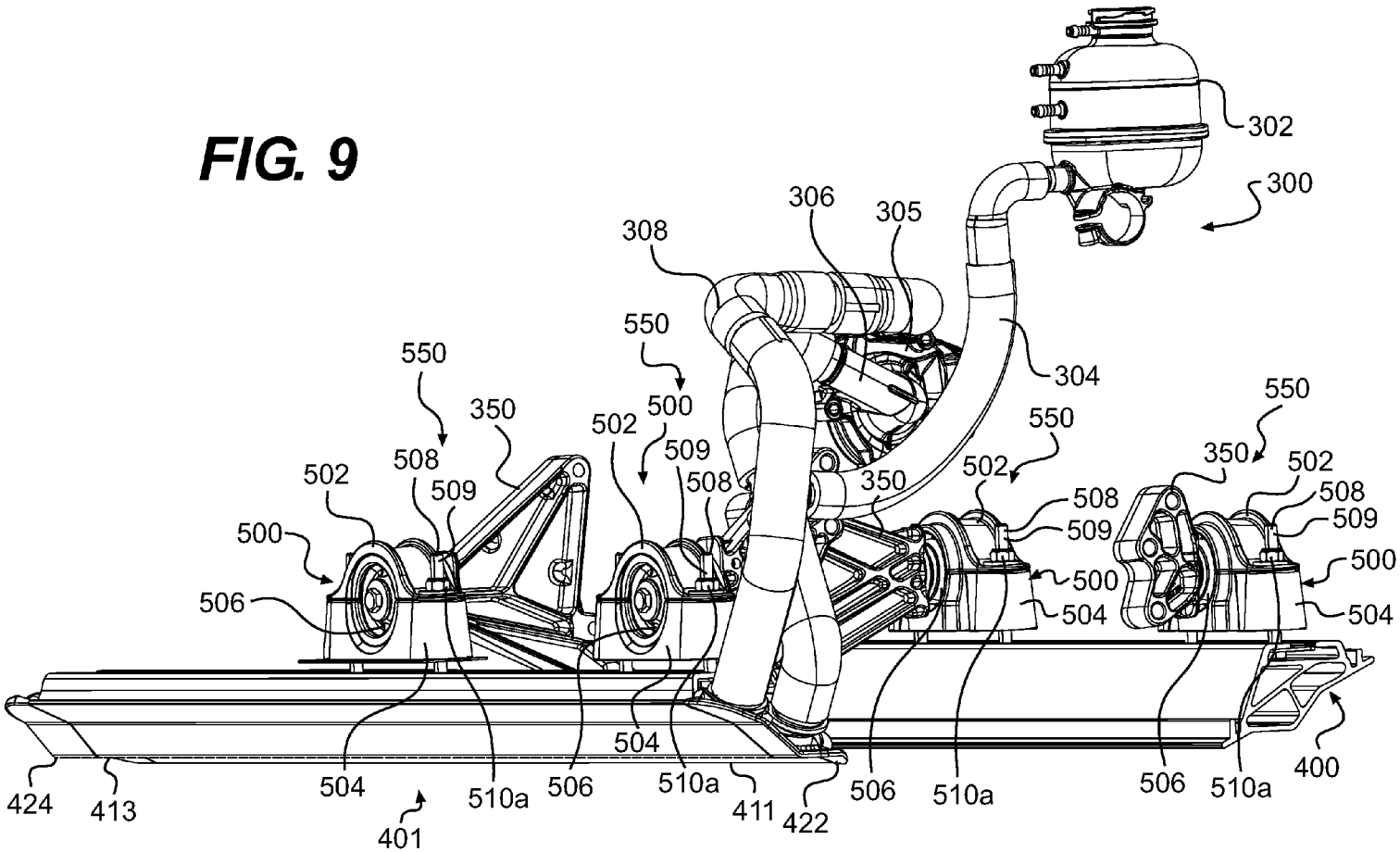
FIG. 9 is a perspective view taken from a front, right side of elongated members, a cooling system and connectors to the engine of the watercraft of FIG. 1 with the hull removed for clarity.

As best seen in FIG. 9, the engine mounts 500 comprise a top portion 502, a bottom portion 504, a sleeve 506, two fasteners 508, and a plate 511 (shown in FIG. 10) and a nut 510*a* per fastener 508. The top portion 502, the bottom portion 504, the sleeve 506, the nuts 510*a* and top ends 509*a* (shown in FIG. 10) of the fasteners 508 are disposed on the inside 13 of the hull 12 and connect to the engine brackets 350. The plates 511 and bottom ends 509*b* (shown in FIG. 10) of the fasteners 508 are disposed outside the hull 12, and connect to the elongated members 400, 401. The fasteners 508 extend through the hull 12 connecting the engine 200 to the elongated members 400, 401.

The top portion 502 is made of aluminum, and the bottom portion 504 is made of plastic. It is contemplated that the top portion 502 could be made of plastic and that the bottom portion 504 could be made of aluminum. It is also contemplated that both the top portion 502 and the bottom portion 504 could be made of plastic or of aluminum. The top portion 502 and the bottom portion 504 are sandwiching a sleeve 506. The sleeve 506 is a piece of elastomer disposed around an end of the engine bracket 350. The sleeve 506 absorbs some of the vibrations of the engine 200. It is contemplated that the sleeve 506 could be made of a material other than polyurethane. For example, the sleeve 506 could be made of rubber. For each engine mount 500, the top portion 502 and the bottom portion 504 are secured to each other by two fasteners 508. A top end 509*a* of each fastener 508 is threaded and receives a corresponding nut 510*a*. A bottom end 509*b* (shown in FIG. 10) of each fastener 508 includes a bolt head 510*b*. As will be described below, the fasteners 508 also secure the elongated members 400, 401 to the hull 12. By using a same fastener 508 to connect the engine 200 to the hull 12, and the elongated members 400, 401 to the hull 12, at least a portion of the forces transmitted by the engine 200 is transferred to the elongated members 400, 401, and not directly by the hull 12. It is contemplated that the top portion 502 and the bottom portion 504 could be connected to each other by a type of fastener different than the fastener 508 shown in the Figures. It is also contemplated that the top portion 502 and the bottom portion 504 could be connected to each other by a first fastener, and that the engine mount 500 as a whole could be connected to the elongated members 400, 401 by a second fastener (same or different from the fastener 508) engaged in the engine mount 500. It is also contemplated that the bottom portion 504 could be integrally formed with the hull 12.

Figure 10:
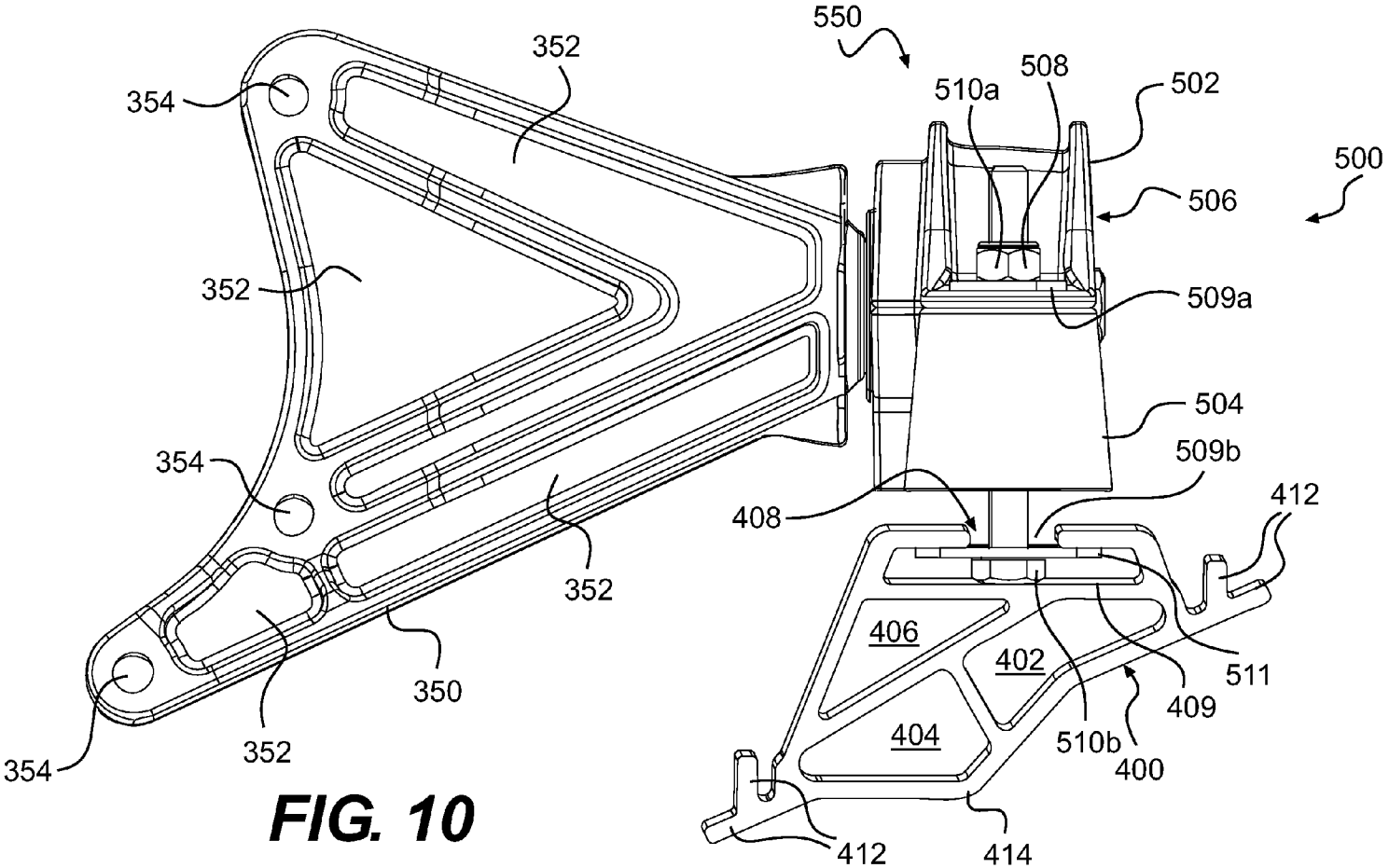
FIG. 10 is a rear plan view of one of the elongated members connected to one of the connectors of FIG. 9.
Figure 11:
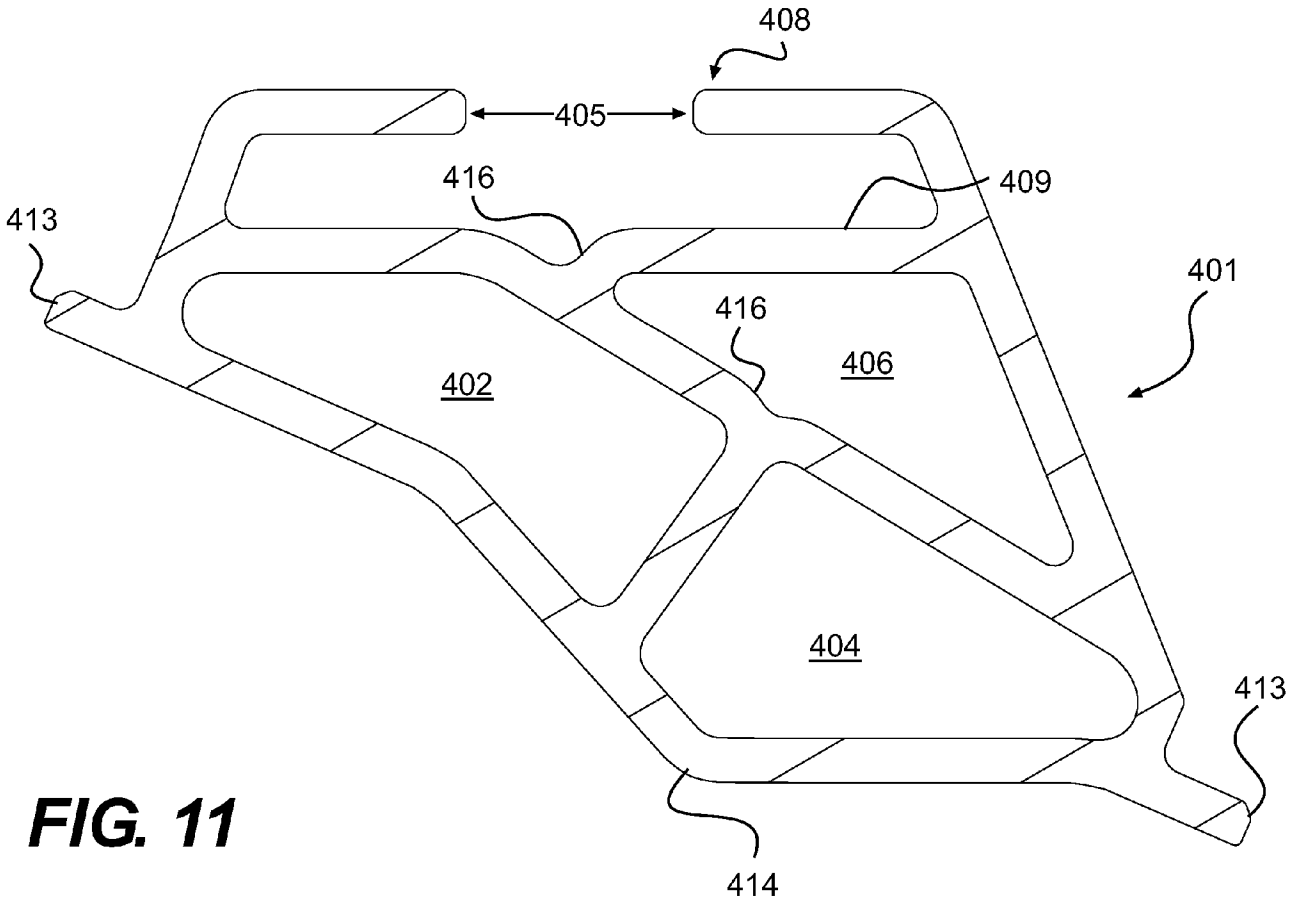
FIG. 11 is a cross-sectional view of the other one of the elongated member of FIG. 9.
Figure 12:
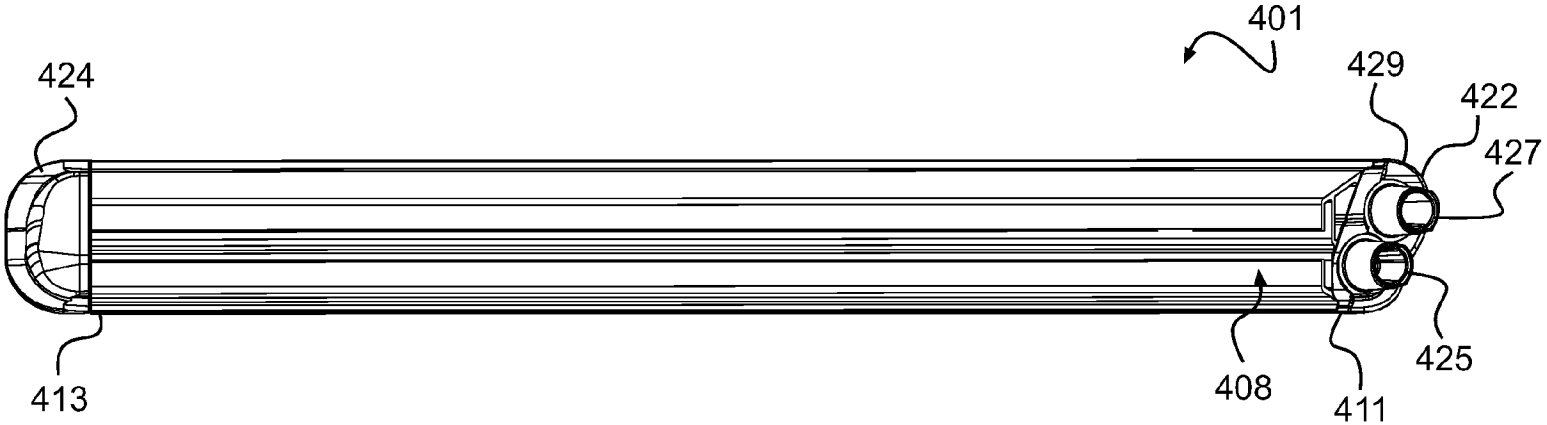
FIG. 12 is a perspective view taken form a top, right side of the elongated member of FIG. 11 with connections to heat exchange conduits for use as a heat exchanger.

Turning now to FIGS. 10 to 12, the elongated members 400, 401 for the boat 100 will be described. The elongated members of the boat 100 are similar to the ones of the watercraft 10, and will therefore not be described separately herein.

Referring to FIG. 10, the elongated member 400 will be first described. The elongated member 400 is connected to the engine 200. The elongated member 400 is disposed on the outside surface 15 of the hull 12, vertically below the engine 200 and forward of the jet propulsion unit 30. As mentioned above, the elongated member 400 connects to the engine 200 via the connectors 550. The connectors 550 include the fasteners 508 which extend through apertures (not shown) in the hull 12. The apertures are wider than a diameter of the fasteners 508 so that the user can adjust a position of the fasteners 508 and the engine mounts 500 within a pair of rails 408 of the elongated member 400 for positioning of the engine 200 with precision. The apertures are made waterproof. A seal is put at the apertures from the inside 13 of the hull 12. It is contemplated that the apertures could be made waterproof differently. It is contemplated that only a portion of the elongated member 400 could extend forwardly of the jet propulsion unit 30. It is also contemplated that the elongated member 400 could be connected to a portion of the power pack other than the engine 200. For example, the elongated member 400 could be connected to the exhaust system, the oil tank 260, the airbox 213, or the battery. It is also contemplated that the elongated member 400 could be connected to more than one portion of the power pack.

The elongated member 400 is a unitary piece of aluminum. A stiffness of the elongated members 400 in the longitudinal direction 6 is greater than a stiffness of the hull 12. Hence, the elongated member 400 is a reinforcement piece to the hull 12.

It is contemplated that the elongated member 400 could be made of two or more pieces. It is also contemplated that the elongated member 400 could be made of a material different from aluminum. For example, the elongated member 400 could be made of carbon composite or stainless steel.

The elongated member 400 has internal apertures 402, 404, 406 extending longitudinally therein. The internal apertures 402, 404, 406 allow the elongated member to be lighter. It is contemplated that the elongated member 400 could have none, only one, two or more than three internal apertures.

The elongated member 400 has the pair of rails 408 extending longitudinally, which is used to secure the elongated member 400 to the hull 12 via the fasteners 508. The pair of rails 408 allows a user installing the engine 200 in the watercraft 10 to determine a precise position in the watercraft 10 where to mount the engine 200 by adjusting a position of the engine mounts 500 in the pair of rails 408. The plate 511 is disposed between the bolt head 510*b* and an inside of the pair of rails 408. The rails of the pair of rails 408 are disposed at a distance 405 (shown in FIG. 11 for the elongated member 401) from each other that is narrower than a size of the plate 511, so that the plate 511 abuts the inside of the pair of rails 408. The bolt head 510*b* abuts against a surface 409 of the elongated member 400, opposite to the pair of rails 408. The pair of rails 408 allows to fasten two engine mounts 500 on the same pair of rails 408 and hence on the same elongated member 400. It is contemplated that only one engine mount 500 could be connected to the pair of rails 408. It is contemplated that each elongated member 400 could have more than one pair of rails 408. For example, two pairs of rails could be disposed next to each other longitudinally at locations corresponding to a connection to each of the engine mount 500. It is also contemplated that the pair of rails 408 could be omitted and that the elongated member 400 could be connected to the engine mounts 500 by way other than by the bolt head 510*b* and the plate 511 engaged in the pair of rails 408. For example, the elongated member 400 and the engine mounts 500 could be connected to each other by one or more double eccentric fastening devices. It is contemplated that the pair of rails 408 could be shorter than shown in the Figures. It is also contemplated that the pair of rails 408 could be replaced by a single rail.

Figure 7:
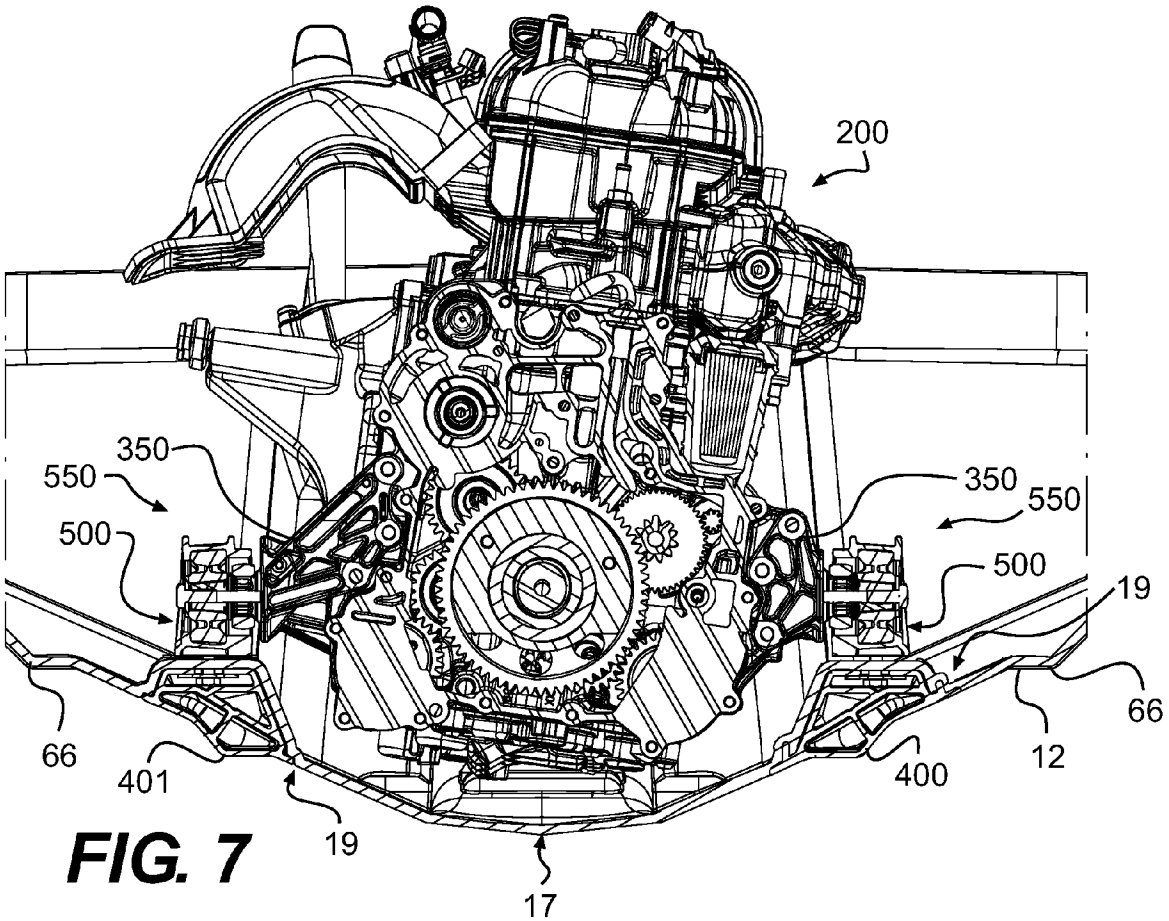
FIG. 7 is a cross-sectional view taken along line 7-7 of FIG. 6.

The elongated member 400 has flanges 412, which, as best seen in FIG. 7, are abutting against the outside surface 15 of the hull 12. It is contemplated that the flanges 412 could be omitted. It is also contemplated that the elongated member 400 could have only one flange 412 per side, or more than two flanges 412 per side. It is also contemplated that the elongated member 400 could have the flanges 412 only on one side thereof.

The elongated member 400 has an apex 414 running along the length of the elongated member 400. As best seen in FIG. 7, when the elongated member 400 is connected to the hull 12, the apex 414 forms a portion of a strake of the hull 12. It is contemplated that the apex 414 could be omitted. It is contemplated that the elongated member 400 could be shaped and mounted to form a chine of the hull 12. It is also contemplated that more than one apex 414 could be formed on the elongated member 400.

Referring to FIGS. 11 and 12, the elongated member 401 will be now described. The elongated member 401 is similar to the elongated member 400 described above, except that the elongated member 401 has only one flange 413 on each side thereof, in place of the flanges 412, and features indentations 416. A difference between the flanges 412 and the flanges 413 and the presence of the indentations 416 are a result of the extrusion process. Elements commons to the elongated member 400, 401 will not be repeated and have been numbered with same reference numerals. The elongated member 401 is made of heat conductive material. It is contemplated that the elongated member 401 could not have the indentations 416, and that the elongated member 400 could have the indentations 416. It is also contemplated that the flanges 413 could be replaced by the flanges 412, and that the flanges 412 could be replaced by the flanges 413. It is also contemplated that the elongated member 401 could not be similar to the elongated member 400.

The internal apertures 402 and 404 of the elongated member 401 are used for transporting a coolant (not shown) for using the elongated members 401 as a heat exchanger. A side forming the internal apertures 402, 404 is in contact with the body of water for ensuring heat transfer. The internal aperture 406 is free of coolant. It is contemplated that only one internal aperture 402 could be used to transport the coolant. It is also that the internal aperture 406 could be omitted, or that the elongated member 401 could have more than one of each of the internal apertures 402, 404 or 406.

The elongated member 401 has one end 411 connected to a conduit connector 422 and another end 413 connected to a U-shaped conduit 424. The U-shaped conduit 424 fluidly connects the internal apertures 402 and 404 to each other. The conduit connector 422 connects the internal apertures 404, 402 to the conduits 306, 308 of coolant, mentioned above. The conduit connector 422 has a back plate 429 which, when the elongated member 401 is disposed on the hull 12, covers the inlet port 425 and the outlet port 427. The conduit connector 422 and the U-shaped conduit 424 are made of aluminum, and are welded to the elongated member 401. It is contemplated that the conduit connector 422 and the U-shaped conduit 424 could be made of a material other than aluminum, and could be connected to the elongated member 401 differently.

When in operation, the coolant flows through the engine 200 and exits the engine 200 though the conduit 306. The coolant then goes from the conduit 306 into the inlet port 425. From the inlet port 425, the coolant flows though the internal aperture 404 longitudinally along the elongated member 401, and then reaches the U-shaped conduit 424. After flowing through the U-shaped conduit 424, the coolant flows though the internal aperture 402 longitudinally along the elongated member 401, and exits through the outlet port 427. The coolant then flows in the conduit 308 back to the engine 200. It is contemplated that the above hydraulic connections would be modified if more than one elongated member 401 were present in the watercraft 10. For example, if the watercraft 10 had two elongated members 401 connected in series, the coolant would exit the outlet port 427 of one of the elongated member 401 to enter the inlet port 425 of the other elongated member 401. In another example, if the watercraft 10 had two elongated member 401 connected in parallel, conduits additional to the ones recited above would be connected to the engine 200 and the reservoir 302. It is contemplated that there could be more than one reservoir 302. It is contemplated that the conduit connector 422 be replaced by the U-shaped conduit 424, and the U-shaped conduit 424 be replaced by the conduit connector 422, so that the coolant would flow in a direction opposite to the one described herein. It is also contemplated that the coolant could flow only in one direction. For example, the aperture 402 could be connected to the inlet port 427, and the end 413 could be connected to an outlet port.

To assemble the elongated member 400 to the hull 12, the user first inserts one of the two fasteners 508 of each engine mount 500 to the elongated member 400. The plate 511 is disposed onto the bottom end 509*b* of the fastener 508. The user then slides the fastener 508 with the plate 511 attached thereto, into the elongated member 400 so that they abut against the inside of the pair of rails 408. The user positions the fastener 508 with the plate 511 attached thereto at a location on the elongated member 400 corresponding to the aperture in the hull 12. The user repeats the above for another fastener 508 for the elongated member 40, and then disposes the elongated member 400 with the two fasteners 508 engaged in the elongated member 400 into the corresponding apertures of the hull 12. The user then disposes the bottom portions 504 onto each of the two fasteners 508 so that the fasteners 508 extend through the bottom portions 504. The user disposes the corresponding engine brackets 350 with the sleeves 506 fitted thereonto, onto the bottom portions 504, and the top portions 502 onto the engine brackets 350 and the bottom portions 504, so that the top ends 509*a* of the fasteners 508 extend through the top portions 502. The user secures the elongated member 400 to the engine mounts 500 by securing the nuts 510*a* to the top ends 509*a* of the fasteners 508. The user can secure the engine 200 to the engine brackets 350 before or after assembling the elongated member 400 to the hull 12.

To assemble the elongated member 401 to the hull 12, the user proceeds similarly to above with respect to the elongated member 400. In addition the user connects the conduits 306, 308 before or after securing the elongated member 401 to the corresponding engine mounts 500, so as to connect to the cooling system 300.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A watercraft comprising:

a hull having an inside and an outside surface;

a deck disposed on the hull, the deck and the hull defining an engine compartment;

a power pack disposed in the engine compartment, the power pack comprising an engine;

a propulsion unit operatively connected to the power pack;

at least one elongated member disposed on the outside surface of the hull, the at least one elongated member being disposed at least in part forwardly of the propulsion unit, the at least one elongated member including at least one heat exchanger in fluid communication with the power pack, the at least one heat exchanger being positioned on the hull to be at least partially in contact with a body of water when the watercraft is in use; and at least one connector mounting a portion of the engine to the at least one elongated member and thereby attaching the portion of the engine to the hull, the at least one connector extending through the hull.

2. The watercraft of claim 1, wherein the at least one elongated member is removably mounted to the hull.

3. The watercraft of claim 1, wherein a stiffness of the at least one elongated member is greater than a stiffness of the hull.

4. The watercraft of claim 1, wherein the at least one elongated member includes at least one rail;

the at least one connector has a first portion engaged with the portion of the engine; and the at least one connector has a second portion engaged with the at least one rail.

5. The watercraft of claim 4, wherein for each of the at least one rail:

the at least one connector is two connectors;

the two connectors have their respective first portions engaged in the portion of the engine; and the two connectors have their respective second portions engaged in the at least one rail.

6. The watercraft of claim 1, wherein the watercraft has a longitudinal direction; and the at least one elongated member is disposed on the outside surface of the hull and extends in the longitudinal direction of the watercraft.

7. The watercraft of claim 6, wherein the at least one elongated member is shaped to form at least one strake of the hull.

8. The watercraft of claim 1, wherein the hull further comprises a keel centrally disposed thereonto; and the at least one elongated member is laterally spaced from the keel.

9. The watercraft of claim 1, wherein the at least one connector includes at least one engine mount supporting the engine, a bottom surface of the engine being spaced from an inside surface of the hull.

10. The watercraft of claim 9, wherein the at least one connector further includes at least one engine bracket connected to the engine, the at least one engine bracket being received in part in the at least one engine mount, the at least one engine mount supporting the engine via the engine bracket.

11. The watercraft of claim 1, wherein the hull includes at least one elongated recess sized and shaped to receive the at least one elongated member at least partially therein.

12. The watercraft of claim 1, wherein the at least one heat exchanger is in fluid communication with the engine.

13. The watercraft of claim 12, wherein the at least one connector includes at least one engine mount connected to the engine;

the at least one elongated member includes at least one rail;

the at least one connector has a first portion engaged with the engine; and the at least one connector has a second portion engaged with the at least one rail.

14. The watercraft of claim 12, further comprising at least one conduit fluidly connecting the engine to the at least one heat exchanger, the at least one conduit carrying a coolant.

15. The watercraft of claim 14, wherein the at least one heat exchanger includes at least one internal aperture, and when in operation the coolant is transported through the at least one internal aperture from the at least one conduit.

16. A watercraft comprising:

a hull having an inside and an outside surface;

a deck disposed on the hull, the deck and the hull defining an engine compartment;

a power pack disposed in the engine compartment, the power pack comprising an engine, at least a portion of a bottom surface of the engine being spaced from an inside surface of the hull;

a propulsion unit operatively connected to the power pack;

at least one elongated member disposed on the outside surface of the hull, the at least one elongated member being disposed at least in part forwardly of the propulsion unit, the at least one elongated member including at least one heat exchanger in fluid communication with the power pack, the at least one heat exchanger being positioned on the hull to be at least partially in contact with a body of water when the watercraft is in use; and at least one connector connected to the engine and supporting the engine, the at least one portion of the bottom surface of the engine being thereby spaced from the inside surface of the hull, the at least one connector extending through the hull and being connected to the at least one elongated member.

17. The watercraft of claim 16, wherein the at least one elongated member is fastened to the hull by the at least one connector.

18. The watercraft of claim 16, wherein each of the at least one connector comprises:

an engine bracket connected to the engine;

an engine mount connected to the engine bracket and disposed on the hull;

a fastener connected to at least one of the engine mount and the engine bracket, the fastener extending through the hull and being connected to the at least one elongate member, the fastener thereby securing the engine bracket and the elongate member to the hull.

19. The watercraft of claim 18, wherein:

the engine bracket extends at least in part laterally outwardly from the engine to the engine mount;

the engine mount extends at least in part downwardly from the engine bracket; and the at least one elongate member is disposed at least in part below the engine mount.

20. The watercraft of claim 18, further comprising a vibration absorber disposed between the engine bracket and the engine mount.

* * * * *